US011107348B1

(12) United States Patent
Evans

(10) Patent No.: US 11,107,348 B1
(45) Date of Patent: Aug. 31, 2021

(54) PORTABLE RACE STARTING LIGHT ASSEMBLY

(71) Applicant: Tyre Evans, Chicago, IL (US)

(72) Inventor: Tyre Evans, Chicago, IL (US)

( * ) Notice: Subject to any disclaimer, the term of this patent is extended or adjusted under 35 U.S.C. 154(b) by 0 days.

(21) Appl. No.: 17/024,147

(22) Filed: Sep. 17, 2020

(51) Int. Cl.
*G08G 1/0955* (2006.01)
*A63K 3/02* (2006.01)

(52) U.S. Cl.
CPC ..... *G08G 1/0955* (2013.01); *A63K 3/02* (2013.01)

(58) Field of Classification Search
CPC .... A63F 13/52; G08G 1/095; F21W 2111/02; G06K 9/00825
See application file for complete search history.

(56) References Cited

U.S. PATENT DOCUMENTS 598,317 A 2/1898 Grinnell
6,695,460 B1 * 2/2004 Warne ..... G08G 1/095 340/942
8,587,453 B2 11/2013 Cripps
9,770,669 B2 9/2017 Romer
9,981,186 B1 5/2018 Biondo
10,249,186 B2 4/2019 Campbell
2011/0068948 A1 * 3/2011 Edmunds ..... A63K 3/02 340/901
2018/0133597 A1 * 5/2018 Biondo ..... A63F 13/52
2019/0180532 A1 * 6/2019 Melson ..... G07C 7/00
2020/0020177 A1 * 1/2020 Stabel ..... G07C 1/22

* cited by examiner

*Primary Examiner* — Mirza F Alam

(57) ABSTRACT

A portable race starting light assembly for starting a race includes a stand is positionable at a starting line of a race track wherein the stand is configured to be visible to racers. A signal unit is coupled to the stand thereby facilitating the signal unit to be visible to the racers. The signal unit has a set of first indicators and a set of second indicators. Each of the first indicators and the second indicators is actuatable to display a visual countdown to the start of a race to communicate the start of the race to the racers. A remote control is provided and the remote control is in wireless communication with the signal unit. The remote control remotely turns on the signal unit to facilitate a race master to start the race for the racers.

12 Claims, 6 Drawing Sheets

PORTABLE RACE STARTING LIGHT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to starting light devices and more particularly pertains to a new starting light device for starting a race.

(2) Description of Related Art Including Information Disclosed Under 37 CFR 1.97 and 1.98

The prior art relates to starting light devices including a portable drag racing tree that includes an upper portion and a lower portion. The prior art discloses a portable traffic signal that includes a remote control. The prior art discloses a bicycle race starting device that includes a remotely controlled barrier. The prior art discloses a drag racing starting light that includes countdown lights and a foul light.

BRIEF SUMMARY OF THE INVENTION

An embodiment of the disclosure meets the needs presented above by generally comprising a stand is positionable at a starting line of a race track wherein the stand is configured to be visible to racers. A signal unit is coupled to the stand thereby facilitating the signal unit to be visible to the racers. The signal unit has a set of first indicators and a set of second indicators. Each of the first indicators and the second indicators is actuatable to display a visual countdown to the start of a race to communicate the start of the race to the racers. A remote control is provided and the remote control is in wireless communication with the signal unit. The remote control remotely turns on the signal unit to facilitate a race master to start the race for the racers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
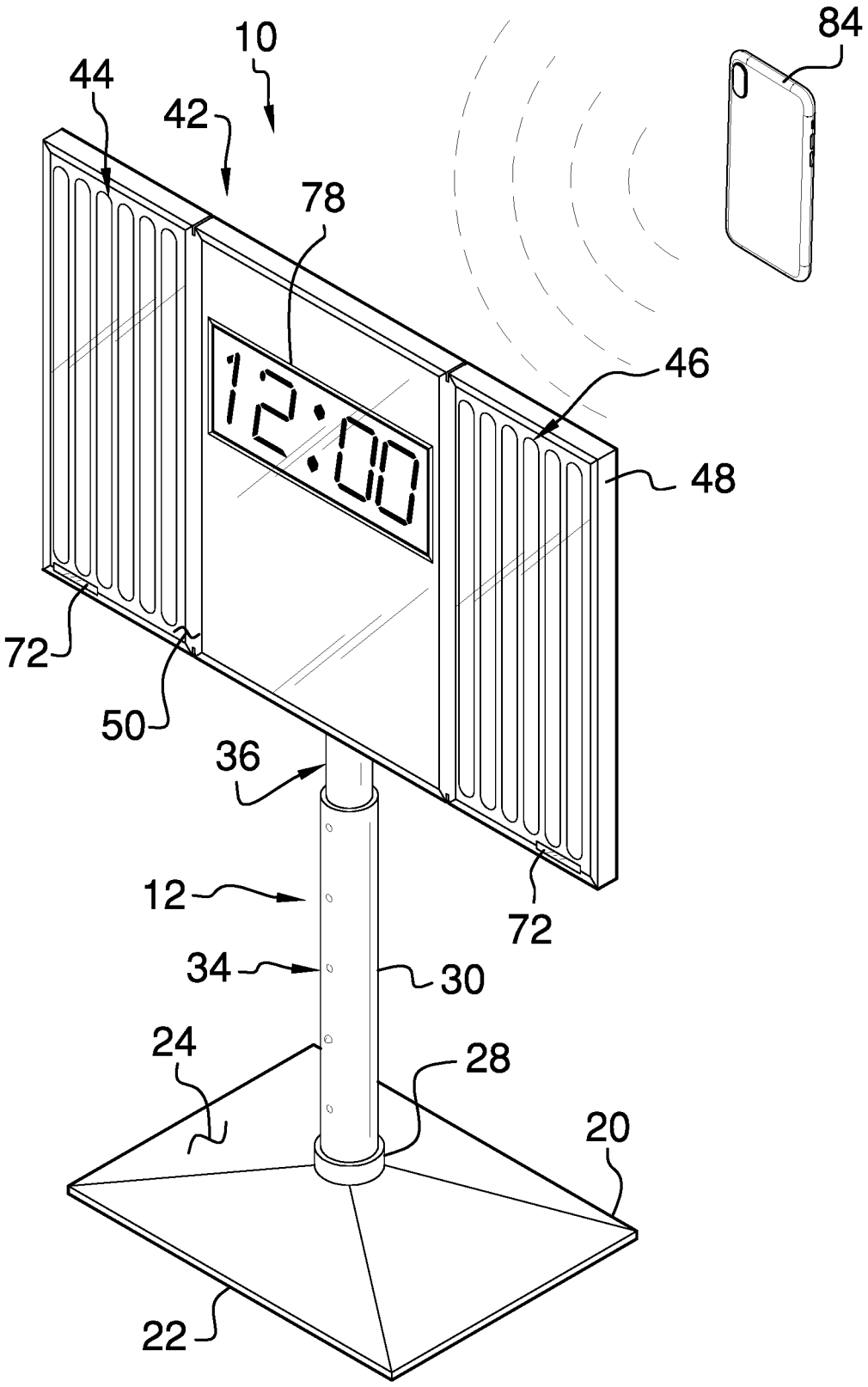
FIG. 1 is a perspective view of a portable race starting light assembly according to an embodiment of the disclosure.
Figure 2:
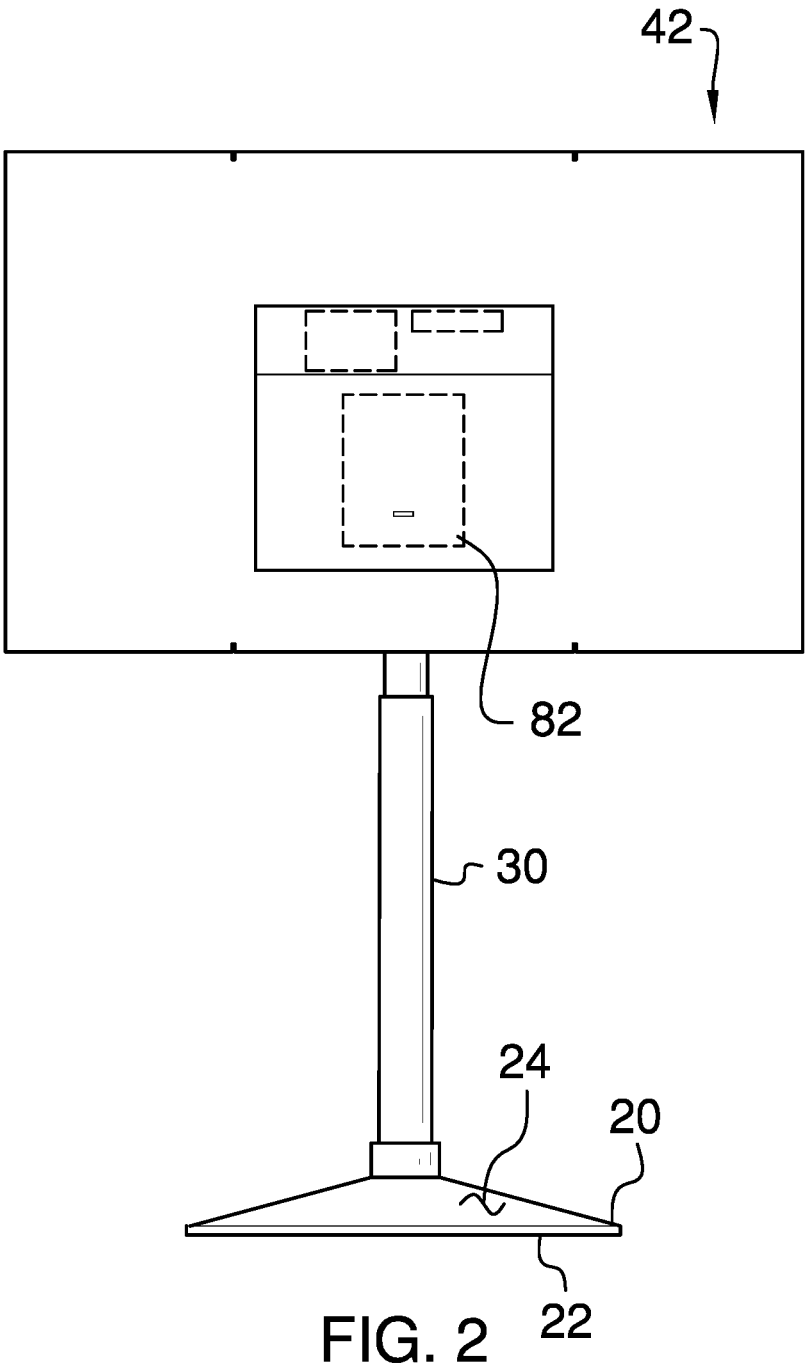
FIG. 2 is a back phantom view of an embodiment of the disclosure.
Figure 3:
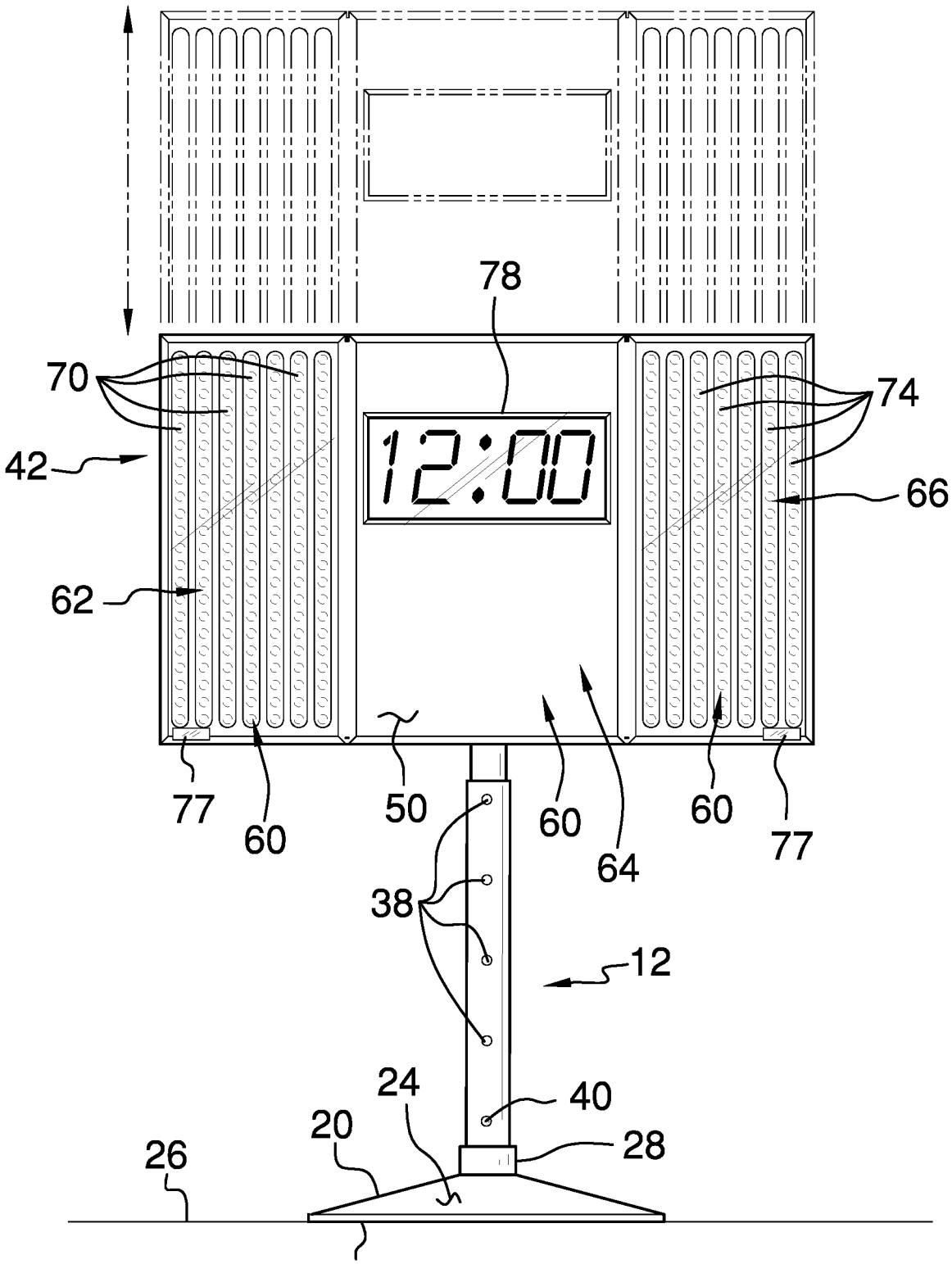
FIG. 3 is a front view of an embodiment of the disclosure.
Figure 4:
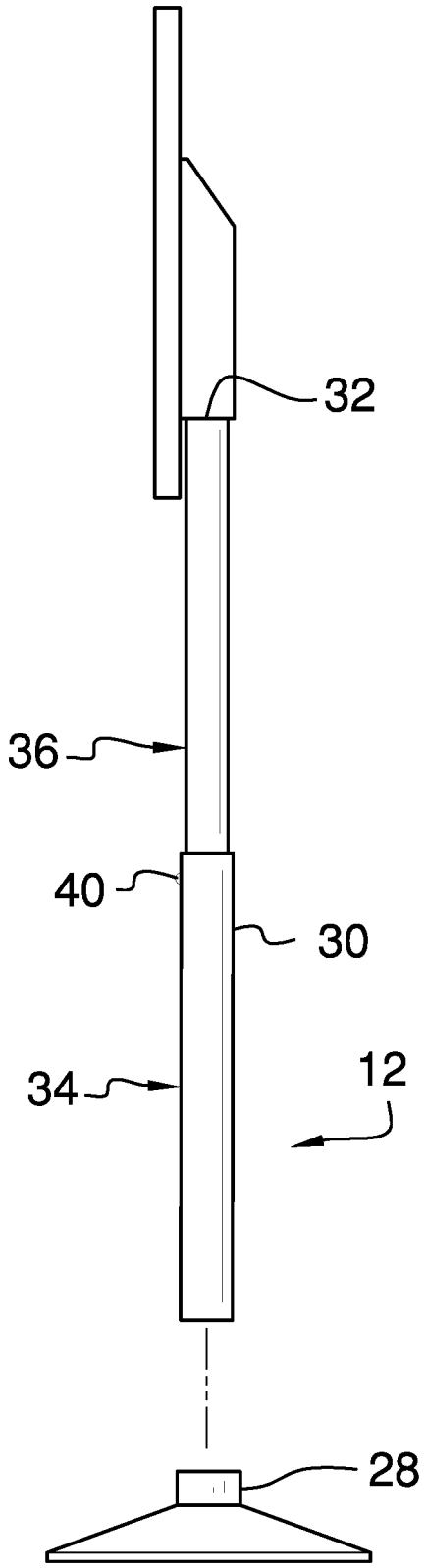
FIG. 4 is a left side exploded view of an embodiment of the disclosure.
Figure 5:
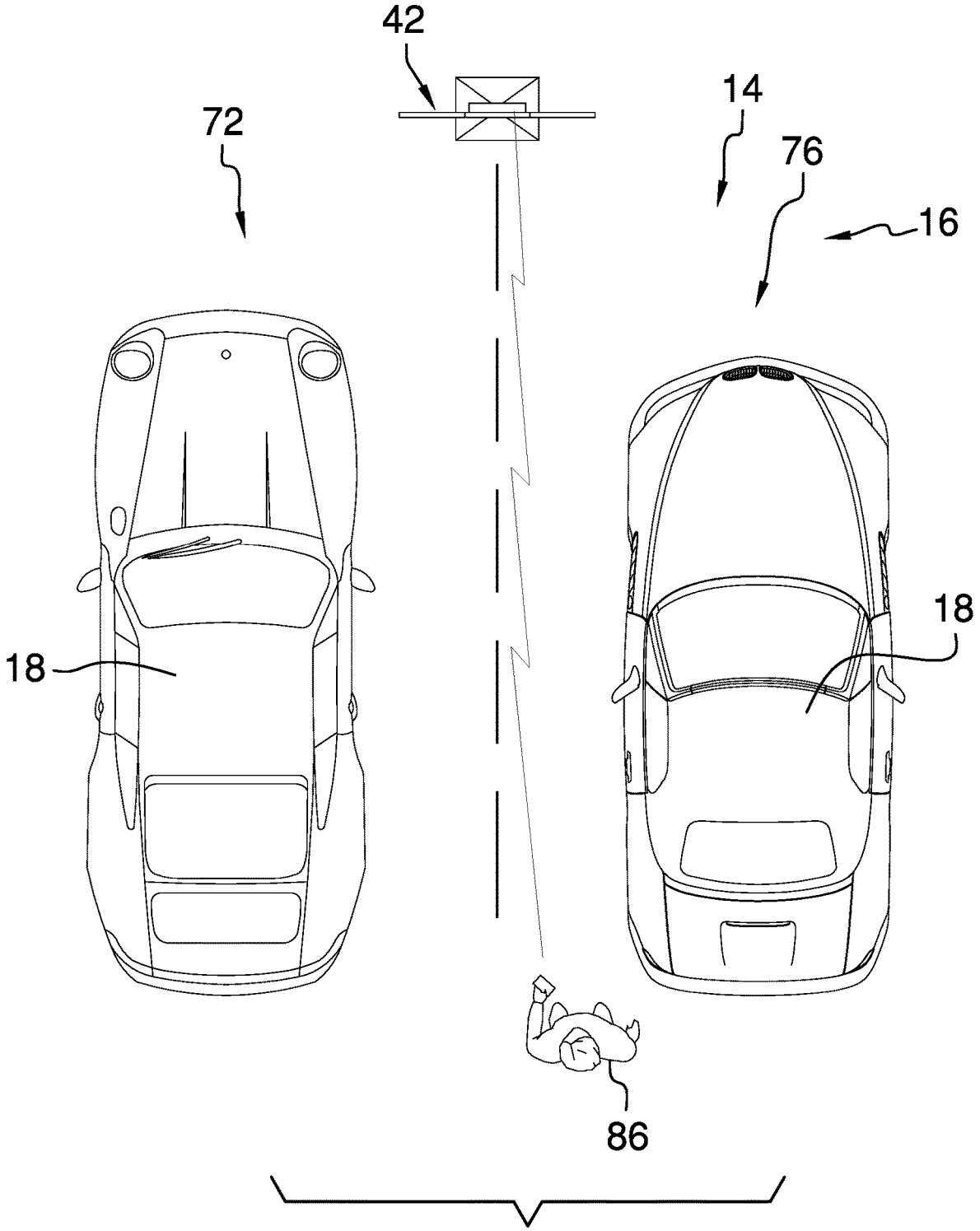
FIG. 5 is a perspective in-use view of an embodiment of the disclosure.
Figure 6:
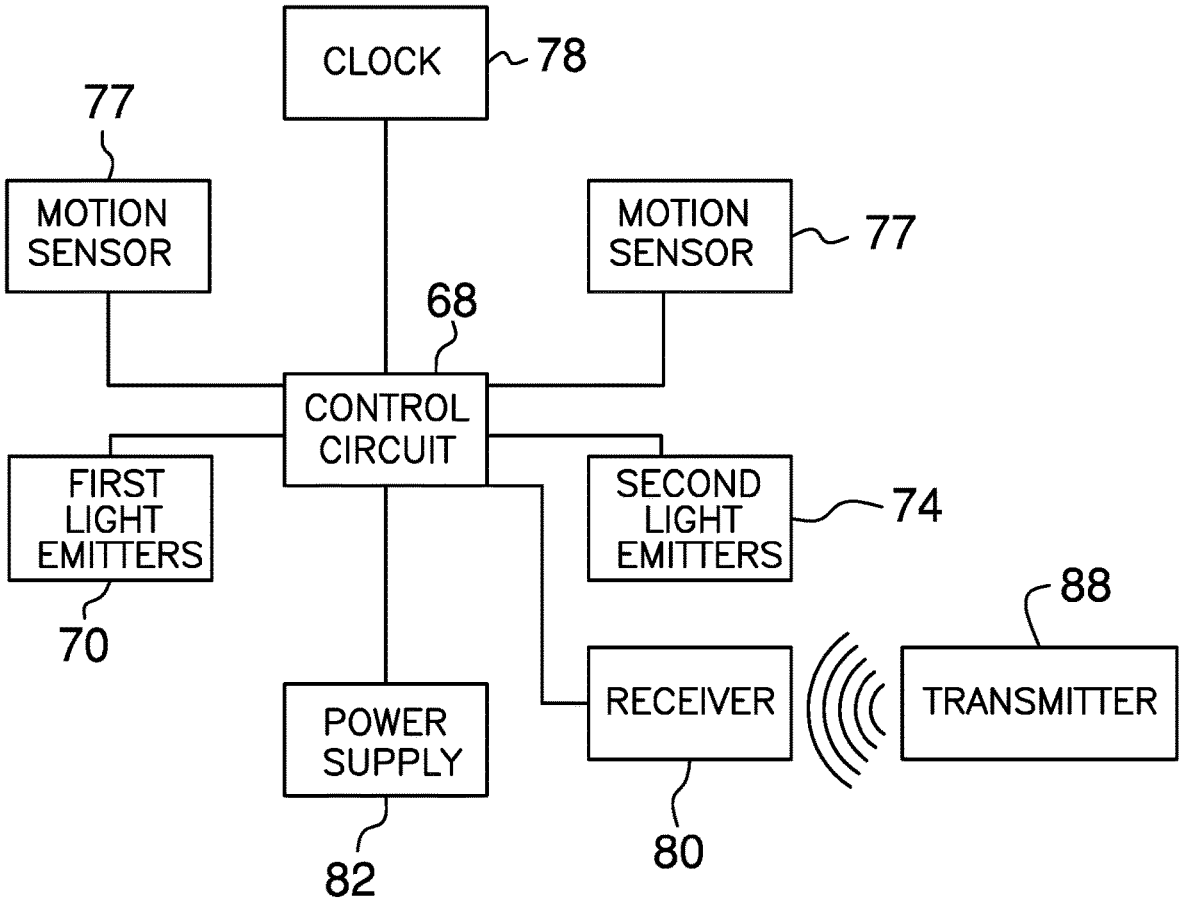
FIG. 6 is a schematic view of an embodiment of the disclosure.

With reference now to the drawings, and in particular to FIGS. 1 through 6 thereof, a new starting light device embodying the principles and concepts of an embodiment of the disclosure and generally designated by the reference numeral 10 will be described.

As best illustrated in FIGS. 1 through 6, the portable race starting light assembly 10 generally comprises a stand 12 that is positionable at a starting line 14 of a race track 16 such that the stand 12 is visible to racers 18. The stand 12 comprises a base 20 that has a bottom surface 22 and a top surface 24, and the bottom surface 22 can rest on a support surface 26. The base 20 is comprised of a weighted material such that the base 20 has a weight of at least 25.0 pounds. A coupler 28 is coupled to the top surface 24 of the base 20 and the coupler 28 is centrally positioned on the base 20.

A pole 30 is coupled to and extends upwardly from the coupler 28 and the pole 30 has a distal end 32 with respect to the coupler 28. The pole 30 comprises a first portion 34 slidably receiving a second portion 36 such that the pole 30 has a telescopically adjustable length. The first portion 34 has a plurality of engagement points 38 thereon. The engagement points 38 are spaced apart from each other and are distributed along a full length of the first portion 34. A lock 40 is movably coupled to the second portion 36 and the lock 40 engages a respective one of the engagement points 38 for retaining the pole 30 at a selected length. Each of the engagement points 38 may comprise a hole and the lock 40 may comprise a ball that is biased outwardly from the second portion 36 for engaging a respective hole.

A signal unit 42 is coupled to the stand 12 thereby facilitating the signal unit 42 to be elevated for enhanced visibility to the racers 18. The signal unit 42 includes a set of first indicators 44 and a set of second indicators 46. Each of the first indicators 44 and the second indicators 46 is actuatable to display a visual countdown to the start of a race. In this way the first indicators 44 and the second indicators 46 communicate the start of the race to the racers 18.

The signal unit 42 comprises a panel 48 that has a forward surface 50 and a perimeter edge 52, and the perimeter edge 52 has a lower side 54, a first lateral side 56 and a second lateral side 58. The lower side 54 is coupled to the distal end 32 of the pole 30 such that the forward surface 50 is directed toward the racers 18. The panel 48 is divided into a plurality of sections 60 and the sections 60 are laterally distributed across the forward surface 50. The plurality of sections 60 includes a left section 62, a middle section 64 and a right section 66.

The signal unit 42 includes a control circuit 68 that is positioned in the panel 48 and the control circuit 68 receives a start input. The plurality of first indicators 44 comprises a plurality of first light emitters 70 that is each coupled to the forward surface 50 of the panel 48 such that the plurality of first light emitters 70 is visible to the racers 18. Each of the first light emitters 70 is positioned on the left section 62 and the plurality of first light emitters 70 is spaced apart from each other and is distributed between the first lateral side 56 of the perimeter edge 52 of the panel 48 and the middle section 64. Additionally, each of the first light emitters 70 extends along a full height of the panel 48 and each of the first light emitters 70 is electrically coupled to the control circuit 68.

The plurality of first light emitters 70 is sequentially turned on from the first lateral side 56 to the middle section 64 when the control circuit 68 receives the start input. Moreover, the first light emitter 70 that is positioned adjacent to the middle section 64 has a green color. In this way the first light emitter 70 adjacent to the middle section 64 indicates a start of the race for the racer 18 in the left lane 72 of the race track 16. Each of the first light emitters 70 may comprise an LED or the like and the plurality of first light emitters 70 may include red light emitters and yellow light emitters.

The plurality of second indicators 46 comprises a plurality of second light emitters 74 that is each coupled to the forward surface 50 of the panel 48 such that the plurality of second light emitters 74 is visible to the racers 18. Each of the second light emitters 74 is positioned on the right section 66 and the plurality of second light emitters 74 is spaced apart from each other and is distributed between the second lateral side 58 of the perimeter edge 52 of the panel 48 and the middle section 64. Each of the second light emitters 74 extends along a full height of the panel 48 and each of the second light emitters 74 is electrically coupled to the control circuit 68.

The plurality of second light emitters 74 is sequentially turned on from the second lateral side 58 to the middle section 64 when the control circuit 68 receives the start input. The second light emitter 74 that is positioned adjacent to the middle section 64 has a green color. In this way the second light emitter 74 adjacent to the middle section 64 can start the race for the racer 18 in the right lane 76 of the race track 16. Each of the second light emitters 74 may comprise an LED or the like and the plurality of second light emitters 74 may include red light emitters and yellow light emitters.

A pair of motion sensors 77 is each coupled to the forward surface 50 of the panel 48 and each of the motion sensors 77 is electrically coupled to the control circuit 68. Each of the motion sensors 77 is positioned on a respective left section 62 and right section 66 and each of the motion sensors 77 is assigned to a respective one of the racers 18. The control circuit 68 actuates either the first light emitters 70 or the second light emitters 74 to repeatedly flash to indicate a foul when the motion sensor 77 assigned to either of the racers 18 detects motion before the green light emitter in either of the first light emitters 70 or the second light emitters 74 is turned on.

The signal unit 42 includes a clock 78 that is coupled to the forward surface 50 of the panel 48 such that the clock 78 is visible to the racers 18. The clock 78 is electrically coupled to the control circuit 68 and the clock 78 displays numeral indicia to display a timer to the racers 18. The clock 78 may comprise a digital clock or the like. The signal unit 42 includes a receiver 80 that is positioned in the panel 48 and the receiver 80 is electrically coupled to the control circuit 68. The receiver 80 may comprise a radio frequency receiver or the like and the receiver 80 may employ Bluetooth communication protocols. The signal unit 42 includes a power supply 82 that is positioned in the panel 48, the power supply 82 is electrically coupled to the control circuit 68 and the power supply 82 comprises at least one battery.

A remote control 84 is provided and the remote control 84 is manipulated by a race master 86. The remote control 84 is in wireless communication with the signal unit 42. The remote control 84 remotely turns on the signal unit 42 to facilitate the race master 86 to start the race for the racers 18. The remote control 84 includes a transmitter 88 that is in wireless communication with the receiver 80. Moreover, the control circuit 68 receives the start input when the transmitter 88 broadcasts a start signal to the receiver 80. The remote control 84 may comprise a personal electronic device, such as a smart phone or the like, or other device that can store operational software and that has wireless communication capabilities. Additionally, the personal electronic device may be synched with the receiver 80 using Bluetooth communication protocols. The operational software stored in the personal electronic device may comprise a smart phone app for controlling the signal unit 42 in the convention of drag racing.

In use, the stand 12 is positioned between the left lane 72 and the right lane 76 of the race track 16 and the stand 12 is adjusted to a desired height. The race master 86 manipulates the remote control 84 to actuate the first light emitters 70 and the second light emitters 74. Thus, each of the first light emitters 70 and the second light emitters 74 are sequentially illuminated toward the middle section 64 of the panel 48. The race begins when the green light emitter associated with each of the first light emitters 70 and second light emitters 74 is turned on. In this way the race can be accurately started in any location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable race starting light assembly for indicating a start for a road race, said assembly comprising:

a stand being positionable at a starting line of a race track wherein said stand is configured to be visible to racers;

a signal housing being coupled to said stand such that said signal housing is elevated by said stand wherein said signal housing is configured to be visible to the racers, said signal housing having a set of first indicators and a set of second indicators coupled thereto, each of said first indicators and said second indicators being actuatable to display a visual countdown to the start of a race wherein said first indicators and said second indicators are configured to communicate the start of the race to the racers;

a remote control configured for being manipulated by a race master, said remote control being in wireless communication with said first indicators and said second indicators coupled to said signal housing, said remote control remotely turning on said first indicators and said second indicators on said signal housing wherein said remote control is configured to facilitate the race master to start the race for the racers;

wherein said stand comprises a base having a bottom surface and a top surface wherein said bottom surface is configured to rest on a support surface, said base being comprised of a weighted material, said top surface having a coupler being coupled thereto, said coupler being centrally positioned on said base, and a pole being coupled to and extending upwardly from said coupler, said pole having a distal end with respect to said coupler, said pole comprising a first portion slidably receiving a second portion such that said pole has a telescopically adjustable length, said lower portion having a plurality of engagement points thereon, said engagement points being spaced apart from each other and being distributed along a full length of said lower portion:

said signal housing comprising a panel, said panel being rectangular having a forward surface and a perimeter edge, said perimeter edge having a lower side, a first lateral side and a second lateral side, said lower side being coupled to said distal end of said pole wherein said forward surface is configured to be directed toward the racers, said panel being divided into a plurality of sections, said sections being laterally distributed across said forward surface, said plurality of sections including a left section, a middle section and a right section;

a control circuit being positioned in said panel, said control circuit receiving a start input; and wherein said first indicators comprises a plurality of first light emitters, each of said first light emitters being coupled to said forward surface of said panel wherein said plurality of first light emitters is configured to be visible to the racers, each of said first light emitters being positioned on said left section, said plurality of first light emitters being spaced apart from each other and being distributed between said first lateral side of said perimeter edge of said panel and said middle section, each of said first light emitters extending along a full height of said panel, each of said first light emitters being electrically coupled to said control circuit.

2. The assembly according to claim 1, wherein said stand includes a lock being movably coupled to said upper portion, said lock engaging a respective one of said engagement points for retaining said pole at a selected length.

3. The assembly according to claim 1, wherein said plurality of first light emitters is sequentially turned on from said first lateral side to said middle section when said control circuit receives said start input.

4. The assembly according to claim 1, wherein said first light emitter being positioned adjacent to said middle section having a green color wherein said first light emitter adjacent to said middle section is configured to start the race for the driver in the left lane of the racetrack.

5. The assembly according to claim 1, wherein:

said plurality of first indicators comprises a plurality of first light emitters; and said plurality of second indicators comprises a plurality of second light emitters, each of said second light emitters being coupled to said forward surface of said panel wherein said plurality of second light emitters is configured to be visible to the racers, each of said second light emitters being positioned on said right section, said plurality of second light emitters being spaced apart from each other and being distributed between said second lateral side of said perimeter edge of said panel and said middle section, each of said second light emitters extending along a full height of said panel, each of said second light emitters being electrically coupled to said control circuit.

6. The assembly according to claim 5, wherein said plurality of second light emitters is sequentially turned on from said second lateral side to said middle section when said control circuit receives said start input.

7. The assembly according to claim 5, wherein said second light emitter being positioned adjacent to said middle section having a green color wherein said second light emitter adjacent to said middle section is configured to start the race for the driver in the right lane of the racetrack.

8. The assembly according to claim 1, further comprising a clock being coupled to said forward surface of said panel wherein said clock is configured to be visible to the racers, said clock being electrically coupled to said control circuit, said clock display numeral indicia wherein said clock is configured to display a timer to the racers.

9. The assembly according to claim 1, further comprising a receiver being positioned in said panel, said receiver being electrically coupled to said control circuit.

10. The assembly according to claim 1, further comprising a power supply being positioned in said panel, said power supply being electrically coupled to said control circuit, said power supply comprising at least one battery.

11. The assembly according to claim 9, wherein said remote control includes a transmitter being in wireless communication with said receiver, said control circuit receiving said start input when said transmitter broadcasts a start signal to said receiver.

12. A portable race starting light assembly for indicating a start for a road race, said assembly comprising:

a stand being positionable at a starting line of a race track wherein said stand is configured to be visible to racers, said stand comprising:

a base having a bottom surface and a top surface wherein said bottom surface is configured to rest on a support surface, said base being comprised of a weighted material, said top surface having a receiver being coupled thereto, said receiver being centrally positioned on said base;

a pole being coupled to and extending upwardly from said receiver, said pole having a distal end with respect to said receiver, said pole comprising a first portion slidably receiving a second portion such that said pole has a telescopically adjustable length, said lower portion having a plurality of engagement points thereon, said engagement points being spaced apart from each other and being distributed along a full length of said lower portion; and a lock being movably coupled to said upper portion, said lock engaging a respective one of said engagement points for retaining said pole at a selected length;

a signal housing being coupled to said stand such that said signal housing is elevated by said stand wherein said signal housing is configured to be visible to the racers, said signal housing having a set of first indicators and a set of second indicators coupled thereto, each of said first indicators and said second indicators being actuatable to display a visual countdown to the start of a race wherein said first indicators and said second indicators are configured to communicate the start of the race to the racers;

said signal housing comprising a panel, said panel being rectangular having a forward surface and a perimeter edge, said perimeter edge having a lower side, a first lateral side and a second lateral side, said lower side being coupled to said distal end of said pole wherein said forward surface is configured to be directed toward the racers, said panel being divided into a plurality of sections, said sections being laterally distributed across said forward surface, said plurality of sections including a left section, a middle section and a right section;

a control circuit being positioned in said panel, said control circuit receiving a start input;

said plurality of indicators comprises a plurality of first light emitters, each of said first light emitters being coupled to said forward surface of said panel wherein said plurality of first light emitters is configured to be visible to the racers, each of said first light emitters being positioned on said left section, said plurality of first light emitters being spaced apart from each other and being distributed between said first lateral side of said perimeter edge of said panel and said middle section, each of said first light emitters extending along a full height of said panel, each of said first light emitters being electrically coupled to said control circuit, said plurality of first light emitters being sequentially turned on from said first lateral side to said middle section when said control circuit receives said start input, said first light emitter being positioned adjacent to said middle section having a green color wherein said first light emitter adjacent to said middle section is configured to start the race for the driver in the left lane of the racetrack;

said plurality of second indicators comprises a plurality of second light emitters, each of said second light emitters being coupled to said forward surface of said panel wherein said plurality of second light emitters is configured to be visible to the racers, each of said second light emitters being positioned on said right section, said plurality of second light emitters being spaced apart from each other and being distributed between said second lateral side of said perimeter edge of said panel and said middle section, each of said second light emitters extending along a full height of said panel, each of said second light emitters being electrically coupled to said control circuit, said plurality of second light emitters being sequentially turned on from said second lateral side to said middle section when said control circuit receives said start input, said second light emitter being positioned adjacent to said middle section having a green color wherein said second light emitter adjacent to said middle section is configured to start the race for the driver in the right lane of the racetrack;

a clock being coupled to said forward surface of said panel wherein said clock is configured to be visible to the racers, said clock being electrically coupled to said control circuit, said clock display numeral indicia wherein said clock is configured to display a timer to the racers;

a receiver being positioned in said panel, said receiver being electrically coupled to said control circuit;

a power supply being positioned in said panel, said power supply being electrically coupled to said control circuit, said power supply comprising at least one battery; and a remote control being manipulated by a race master, said remote control being in wireless communication with said control circuit, said remote control including a transmitter being in wireless communication with said receiver, said control circuit receiving said start input when said transmitter broadcasts a start signal to said receiver.

* * * * *